US010526569B2

(12) United States Patent
Boyst et al.

(10) Patent No.: US 10,526,569 B2
(45) **Date of Patent: *Jan. 7, 2020**

(54) MULTI-PURPOSE, HARD SURFACE CLEANER

(71) Applicant: Klear Solutions, Carson City, NV (US)

(72) Inventors: Evan Boyst, Belleville, MI (US); Patricia Hamilton, Placerville, CA (US)

(73) Assignee: Klear Solutions, Carson City, NV (US)

( * ) Notice: Subject to any disclaimer, the term of this patent is extended or adjusted under 35 U.S.C. 154(b) by 1 day.

This patent is subject to a terminal disclaimer.

(21) Appl. No.: 15/817,901

(22) Filed: Nov. 20, 2017

(65) Prior Publication Data

US 2018/0072971 A1 Mar. 15, 2018

Related U.S. Application Data

(63) Continuation of application No. 14/773,948, filed as application No. PCT/US2014/028355 on Mar. 14, 2014, now Pat. No. 9,850,456.

(60) Provisional application No. 61/792,950, filed on Mar. 15, 2013.

(51) Int. Cl.

| | |
|---|---|
| ***C11D 1/72*** | (2006.01) |
| ***C11D 1/86*** | (2006.01) |
| ***C11D 3/02*** | (2006.01) |
| ***C11D 17/00*** | (2006.01) |
| ***C11D 3/04*** | (2006.01) |
| ***C11D 3/12*** | (2006.01) |
| ***C11D 3/22*** | (2006.01) |
| ***C11D 3/30*** | (2006.01) |
| ***C11D 3/37*** | (2006.01) |
| ***C11D 3/43*** | (2006.01) |
| ***C11D 1/88*** | (2006.01) |
| ***C11D 1/94*** | (2006.01) |
| ***C11D 3/14*** | (2006.01) |
| ***C11D 1/83*** | (2006.01) |
| ***C11D 1/722*** | (2006.01) |
| ***C11D 3/20*** | (2006.01) |
| ***C11D 3/18*** | (2006.01) |

(52) U.S. Cl.

CPC ..... *C11D 17/0017* (2013.01); *C11D 1/72* (2013.01); *C11D 1/722* (2013.01); *C11D 1/83* (2013.01); *C11D 1/88* (2013.01); *C11D 1/94* (2013.01); *C11D 3/044* (2013.01); *C11D 3/124* (2013.01); *C11D 3/1266* (2013.01); *C11D 3/14* (2013.01); *C11D 3/185* (2013.01); *C11D 3/2068* (2013.01); *C11D 3/2093* (2013.01); *C11D 3/222* (2013.01); *C11D 3/30* (2013.01); *C11D 3/3707* (2013.01); *C11D 3/3765* (2013.01); *C11D 3/43* (2013.01)

(58) Field of Classification Search

CPC .. C11D 1/14; C11D 1/72; C11D 1/722; C11D 1/83; C11D 1/88; C11D 1/94; C11D 3/044; C11D 3/222; C11D 3/2068; C11D 3/2093; C11D 3/43; C11D 17/0017

USPC ..... 510/238, 417, 421, 422, 423, 424, 426, 510/427, 428, 435

See application file for complete search history.

(56) References Cited

U.S. PATENT DOCUMENTS

| | | | | |
|---|---|---|---|---|
| 3,956,162 | A | 5/1976 | Lautenberger | |
| 4,438,009 | A | 3/1984 | Benicek et al. | |
| 4,797,231 | A | 1/1989 | Schumann | |
| 5,523,014 | A | 6/1996 | Dolan et al. | |
| 6,544,532 | B1 | 4/2003 | Jager-Lezer et al. | |
| 6,689,226 | B1 | 2/2004 | Cheung et al. | |
| 9,850,456 | B2 * | 12/2017 | Boyst | C11D 3/044 |
| 2004/0176263 | A1 | 9/2004 | Filippini | |
| 2005/0130873 | A1 | 6/2005 | Cheung | |
| 2005/0233925 | A1 | 10/2005 | Foley | |
| 2005/0239381 | A1 | 10/2005 | Mesa et al. | |
| 2009/0249557 | A1 | 10/2009 | Maki et al. | |
| 2011/0071069 | A1 | 3/2011 | Konishi | |
| 2012/0070388 | A1 | 3/2012 | Man et al. | |

FOREIGN PATENT DOCUMENTS

| | | | |
|---|---|---|---|
| JP | H05-504584 | A | 7/1993 |
| JP | 2001-277480 | A | 10/2001 |
| JP | 2002-540131 | A | 11/2002 |
| JP | 2006-515642 | A | 6/2006 |
| JP | 2006-516155 | A | 6/2006 |
| JP | 2009-530434 | A | 8/2009 |
| JP | 2009-242698 | A | 10/2009 |

(Continued)

OTHER PUBLICATIONS

Search Report dated Jul. 28, 2014; 10 pages.

(Continued)

*Primary Examiner* — Gregory R Delcotto

(74) *Attorney, Agent, or Firm* — Gunther J. Evanina; Butzel Long

(57) ABSTRACT

In one embodiment, a water in oil cleaning composition is disclosed that may include at least one solvent, in an amount of from about, 1-90% (w/w) of the composition, at least one surfactant in an amount of from about 0.1-20% (w/w) of the composition, 3M KOH/de-ionized water, in an amount of from about 1-4% (w/w) of the composition, rheological agents, in an amount of from about 0.1-8% (w/w) of the composition, and emulsifiers, in an amount of from about 0.5-20% (w/w) of the composition. Optionally, the composition may include antimicrobials in an effective amount, and may be present in an amount of from about 1-4% (w/w) of the composition, fragrants and colorants as desired.

8 Claims, No Drawings

(56) References Cited

FOREIGN PATENT DOCUMENTS

| | | | |
|---|---|---|---|
| WO | WO-91-09104 | | 6/1991 |
| WO | WO-1992/09378 | A1 | 6/1992 |
| WO | WO-2001/74984 | A1 | 10/2001 |
| WO | WO-2004-078897 | A1 | 9/2004 |
| WO | WO-2004-078899 | A1 | 9/2004 |
| WO | WO-2007-077953 | A1 | 7/2007 |
| WO | WO-2007-104971 | A1 | 9/2007 |

OTHER PUBLICATIONS

Translation of Office Action, dated Apr. 24, 2018. (5 pages).
Patent Abstract of Japan Publication No. 2001-277480 A, date of publication Oct. 9, 2001.
Patent Abstract of Japan Publication No. 2009-242698 A, date of publication Oct. 22, 2009.
Patent Abstract of Japan Publication No. H05-504584 A, date of publication Jul. 15, 1993.
Patent Abstract of Japan Publication No. 2006-516155 A, date of publication Jun. 22, 2006.
Patent Abstract of Japan Publication No. 2006-515642 A, date of publication Jun. 1, 2006.
Patent Abstract of Japan Publication No. 2002-540131 A, date of publication Nov. 26, 2002.
Patent Abstract of Japan Publication No. 2007-077953 A1, date of publication Jul. 12, 2007.
Patent Abstract of Japan Publication No. 2009-530434 A, date of Publication Aug. 27, 2009.

* cited by examiner

MULTI-PURPOSE, HARD SURFACE CLEANER

CROSS-REFERENCE TO RELATED APPLICATIONS

This continuation application claims priority to U.S. patent application Ser. No. 14/773,948, filed on Sep. 9, 2015, now U.S. Pat. No. 9,850,456, which claims priority to PCT Application No. PCT/US2014/028355, filed on Mar. 14, 2014, and which also claims priority to Provisional Application No. 61/792,950, filed on Mar. 15, 2013, all of which are hereby incorporated by reference in their entireties.

FIELD OF THE DISCLOSURE

The disclosure relates in one embodiment to a multi-purpose cleaning composition for hard surfaces, such as, without limitation, glass surfaces. The cleaning composition is a water in oil emulsion composition having one phase and enhanced rheological properties to permit the cleaning composition to remain in place on hard to remove stains, thereby facilitating cleaning of hard surfaces, such as counter tops, metals (stainless steel, platinum, titanium, gold), ceramic, porcelain, glass, and tile.

SUMMARY OF THE DISCLOSURE

In one embodiment, the cleaning composition is a water in oil emulsion that may include at least one solvent, in an amount of from about 0.1-90% (w/w) of the composition, at least one surfactant in an amount of from about 0.1-20% (w/w) of the composition, sufficient base in water, in an amount of from about 1-90% (w/w) of the composition, rheological agents, in an amount of from about 0.1-20% (w/w) of the composition, and emulsifiers, in an amount of from about 0.5-20% (w/w) of the composition. Optionally, the composition may include antimicrobials in an effective amount, and may be present in an amount of from about 1-4% (w/w) of the composition, fragrances and colorants as desired.

DETAILED DESCRIPTION

In water in oil emulsion composition, water is held in an emulsified state within a hydrophobic solvent so that a cleaning solution may be composed which is able to clean hydrophilic stains and debris, as well as hydrophobic stains and debris. Generally, de-ionized water may be treated with a base. Without limitation, the base may be ammonia, amines, sodium hydroxide, potassium hydroxide, or mixtures thereof, or any other suitable base, or mixtures of bases. By way of example, potassium hydroxide (KOH) may be used to create a KOH/de-ionized water solution. This solution is suspended in emulsion within a hydrophobic solvent by means of emulsifying agents, to create a hydrophilic/hydrophobic emulsion.

Solvents are included which are suitable to clean non water soluble stains or debris from hard surfaces. Any number of solvents suitable for cleaning oil based debris or stain may be suitable for inclusion into the composition, and these solvents may be present either alone, or in combination with each other. The following are not to be construed as limiting the solvents that may find application in the cleaning composition. Exemplary suitable solvents may include dimethyl adipate, dimethyl glutarate, dimethyl succinate (collectively sold under the tradename Rhodiasolv RPDE, available from Rhodia Group), petanedioic acid, 2-methyl-, 1,5-dimethyl ester, dibasic acid esters of the formula $CH_3COO—(CH_2)_n—COOCH_3$, where n is a number from 1-7, and tripropylene glycol methyl ether. These solvents may be present, either alone or in combination, in an amount of from about 10-90% (w/w) of the composition.

Other solvents that may be used include dipropylene glycol methyl ether and propylene glycol n-butyl ether. Propylene glycol methyl ether acetate may also be present in an amount from about 10-20% (w/w). These solvents may be, present, either alone or in combination, in an amount of from about 1-20% (w/w) of the composition.

Other solvents may include monobasic esters of the formula ($R^1—COO—R^2$) where $R^1$ is an alkyl with 1 to 16 carbons and $R^2$ is an alkyl with 1 to 4 carbons. Other solvents may include soybean methyl esters, and ethyl lactate. These solvents may be present, either alone or in combination, in an amount of from about 1-50% (w/w) of the composition.

The composition may also include, where permitted, D-Limonene as a solvent, in an amount of from about 0.1-3% (w/w) of the composition.

Amphoteric surfactants suitable for use include, for example, betaines, alkyl imidazolines, caprylic imidazoline, alkanolamides, cocoamphopropionates, or combinations thereof. When an amphoteric surfactant is utilized, the amphoteric surfactant is preferably used under alkaline conditions to render the anionic portion of the amphoteric compound active. The amphoteric surfactant may be present in an amount ranging from about 0.5 to about 20% (w/w) of the composition.

Suitable nonionic surfactants for use in the cleaning composition include alkoxylated alcohols, ethoxylated polyoxypropylene block copolymers; alkoxylated ether phenols, silicone-based compounds such as silicone glycol copolymers, and semi-polar nonionic surfactants such as trialkyl amine oxides. Monoisopropanolamides may be used if permitted, and could be present in an amount of from about 0.5-5% (w/w). Useful surfactants also include those known under the trade name Sufynol 104, and particularly useful is Surfynol 104E, available from Air Products, act as wetting agents to lower the surface tension of the composition and permit the water in solvent based cleaning solutions act as a solvent on hard surfaces. The nonionic surfactant may be present in an amount ranging from about 0.01 to about 10% (w/w) of the composition.

Suitable anionic surfactants for use include alkyl sulfates, alkyl benzenesulfonates, alkyl taurates, alkyl sacrosinates, alkyl diphenyloxide disulfonates, alkyl naphthalene sulfonates, alkyl ether sulfates, alkyl ether sulfonates, sulfosuccinates, and other anionic surfactants as known for use in cleaning compositions. The surfactants are typically available as the alkali metal, alkaline earth and ammonium salts thereof. Preferred anionic surfactants are alkyl benzenesulfonates such as isopropylamine dodecylbenzene sulfonate; linear and branched dodecylbenzene sulfonates; sodium dodecylbenzenesulfonate (SDBS) and are present in an amount ranging from about 0.5 to about 20% (w/w) of the composition.

Rheological agents may also be added to the composition to provide enhanced flow resistance characteristics so that the formulation remains in place, even on horizontal or ceiling surfaces, for a prolonged period so that particles and stains may react for a longer period of time with the cleaning composition than may be possible with compositions that do not include rheological agents. While many rheological agents may be used and are included in the scope of this invention, certain rheological agents may be more readily amenable to the present composition. For example, cellulose may be used as a rheological agent, as could xanthan gum or other known emulsifiers. The rheological agents may also include fumed silicas, siloxane treated fumed silicas, either alone or in combination, in an amount of from about 0.5-8% (w/w) of the composition; hectorite clay and bentonite, either alone or in combination, in an amount of from about 0.1-6% (w/w) of the composition, or a cellulose thickener in an amount of from about 0.1-6% (w/w). Those skilled in the art further recognize that these rheological agents could be used together in varying amount within the described ranges such that the total amount of rheological agent does not exceed 20% (w/w) of the composition.

As it is contemplated that the composition is water in oil emulsion, stability of the emulsion is enhanced when emulsifiers are used. For example, and without limitation, green emulsifiers that can be used include those known under the trade name Rhodacal® IPAM, an emulsifier available from Solvay which is isopropylamine dodecylbenzene sulfonate. Polyethylene Glycol of a molecular weight of 200 to 2000 may also be used as an emulsifying agent, and is particularly useful in water in oil emulsion compositions. The emulsifiers may be present in an amount of from about 0.5-20% (w/w) of the composition. Exemplary emulsifiers may include poly(ethylene glycol) having a molecular weight of from about 200 to 200, and polyacrylic acid, either alone or in combination, in an amount of from about 0.5-20% (w/w) of the composition.

Adjuvants, such as colorants and fragrants may be added as cosmetically and aesthetically needed, and it may further be desired to include antimicrobials to the composition. For example, and without limitation, cinnamaldehyde may be present in an amount of from about 1-2% (w/w) of the composition which can serve as both antimicrobial and as a fragrance. FD&C Red 40 may be added as colorant. Other suitable fragrant, colorants and antimicrobials may be used as suited by the particular formulator. In addition pH adjustors may be added as suitable for the particular cleaning application to which the composition may be applied.

The following is data showing particular aspects of the cleaning composition in comparison to other formulations showing at least some of the advantages of the particular formulations shown therein. The test results are exemplary only, and should be understood as limiting the scope of the invention described in this application.

EXAMPLES

The following examples are presented to show various aspects of the invention and advantages associated with the particular formulations used. The Examples are illustrative, and are understood not to limit the scope of the invention.

The formula has the ability to cling to the surface of the surface being cleaned to increase the residency time of the cleaner and the area to be cleaned. This allows the cleaner to work without the use of mechanical action or having to soak the entire piece that needs to be cleaned in the cleaning solution. This is advantageous over other cleaners in the market space since excessive mechanical action on delicate substrates, i.e. glass, ceramic could lead them to be damaged or destroyed. It also allows for less cleaner to be used since an entire piece does not have to be submersed in the cleaner.

Other advantages are in compliance with state and federal regulations concerning VOC and surfactant type, in this type of cleaning product; as well as decreasing the amount of time that it takes for this compliant cleaner to work verses other cleaners like "Grunge Off" from Aqua Labs Technologies and "Formula 420" from SCS Enterprises.

Procedure

Glass cleaning compositions according to the present disclosure were prepared as follows by mixing under high shear the solids with the liquids. The following formula will be referred to as Formula 1.

| | Material | Total Formula % (w/w) |
|---|---|---|
| 1 | Rhodiasolv RPDE | 71.61% |
| 2 | Propylene glycol methyl ether acetate | 2.24% |
| 3 | D-Limonene | 2.91% |
| 4 | 3M KOH/DI water | 2.24% |
| 5 | Sipernat 50S | 2.24% |
| 6 | Aerosil 200 | 2.01% |
| 7 | Bentone 38 | 1.34% |
| 8 | PolyEthyleneGlycol (PEG) 200 | 7.16% |
| 9 | Rhodacal IPAM | 6.71% |
| 10 | Surfynol 104 E | 0.04% |
| 11 | FD&C Red 40 | 0.0004% |
| 12 | Cinnamaldehyde | 1.49% |

Glass substrates were prepared for use by soiling them with flame decomposition of vegetable material until a thick residue and resinous deposits were created in multiple spots of the glass. For sake of comparison to marketplace competitors, "Grunge Off" and "Formula 420" were both used according to their directions for soaking the glassware except for this was only performed for 60 minutes. Formula 1 was simply poured through and over a similar dirty glass piece. The dirty glassware were allowed to stand for 60 minutes and then rinsed with water. The glassware was visually evaluated for cleanliness. The results were observed as follows: Formula 1 after 60 minutes and rinse was completely clean and looked like a new piece, "Grunge Off" and "Formula 420", despite being totally immersed in the respective cleaner, only cleaned in the lightly stained area, but heavily soiled areas still mostly soiled.

The embodiments disclosed herein are non-limiting examples that are provided to illustrate and facilitate a better understanding, the scope of the invention being defined by the appending claims as properly construed under the patent laws, including the doctrine of equivalents.

The above description is intended to be illustrative, not restrictive. The scope of the invention should be determined with reference to the appended claims along with the full scope of equivalents. It is anticipated and intended that future developments will occur in the art, and that the disclosed devices, kits and methods will be incorporated into such future embodiments. Thus, the invention is capable of modification and variation and is limited only by the following claims.

What is claimed is:

1. A water-in-oil emulsion cleaning composition, comprising:

a hydrophobic solvent in an amount of from 0.1-90% (w/w) of the composition;

a base/water solution in an amount of from 1% to 4% (w/w) of the composition;

at least one anionic surfactant in an amount of from 0.5% to 20% (w/w) of the composition;

an emulsifying agent, which is at least one of polyethylene glycol of molecular weight of 200 to 2000, isopropylamine dodecylbenzene sulfonate and polyacrylic acid, in an amount of from 13.87% to 20% (w/w) of the composition; and at least one rheological agent in an amount of from 0.1% to 20% (w/w) of the composition.

2. The composition of claim 1, wherein the base is at least one of sodium hydroxide and potassium hydroxide.

3. The composition of claim 1, wherein the at least one rheological agent comprises silica in an amount of from 0.5% to 8% (w/w) of the composition.

4. The composition of claim 1, wherein the at least one rheological agent comprises at least one of hectorite clay and bentonite in an amount totaling from 0.1% to 6% (w/w) of the composition.

5. The composition of claim 1, wherein the at least one rheological agent comprises silica in an amount of from 0.5% to 8% (w/w) of the composition, and at least one of hectorite clay and bentonite in an amount totaling from 0.1% to 6% (w/w) of the composition.

6. The composition of claim 1, wherein the emulsifying agent is a combination of isopropylamine dodecylbenzene sulfonate and polyethylene glycol of molecular weight of 200 to 2000.

7. The composition of claim 1, wherein said hydrophobic solvent is at least one of dimethyl adipate, dimethyl glutarate, dimethyl succinate, petanedioic acid, dibasic acid esters of the formula $CH_3COO—(CH_2)_n—COOCH_3$, where n is a number from 1-7, tripropylene glycol methyl ether, dipropylene glycol methyl ether, propylene glycol n-butyl ether, propylene glycol methyl ether acetate, monobasic esters of the formula ($R_1—COO—R_2$) where R1 is an alkyl with 1 to 16 carbons and R2 is an alkyl with 1 to 4 carbons, soybean methyl esters, ethyl lactate, D-Limonene, and combinations thereof.

8. The composition of claim 7, wherein at least one of dimethyl adipate, dimethyl glutarate, dimethyl succinate, petanedioic acid, dibasic acid esters of the formula $CH_3COO—(CH_2)_n—COOCH_3$, where n is a number from 1-7, or tripropylene glycol methyl ether, is present in an amount about 10-90% (w/w) of the composition.

* * * * *